US008607383B2

(12) United States Patent
Briganti

(10) Patent No.: US 8,607,383 B2
(45) Date of Patent: Dec. 17, 2013

(54) DRAWSTRING FITTED SHEET

(76) Inventor: Robert A. Briganti, Los Altos, CA (US)

( * ) Notice: Subject to any disclaimer, the term of this patent is extended or adjusted under 35 U.S.C. 154(b) by 57 days.

(21) Appl. No.: 13/531,552

(22) Filed: Jun. 24, 2012

(65) Prior Publication Data

US 2012/0324646 A1 Dec. 27, 2012

Related U.S. Application Data

(60) Provisional application No. 61/571,307, filed on Jun. 24, 2011.

(51) Int. Cl.
*A47G 9/02* (2006.01)

(52) U.S. Cl.
USPC ..... 5/497; 5/496; 5/499

(58) Field of Classification Search
USPC ..... 5/495–499
See application file for complete search history.

(56) References Cited

U.S. PATENT DOCUMENTS

| | | | | |
|---|---|---|---|---|
| 3,900,909 | A * | 8/1975 | Monier et al. | 5/496 |
| 5,046,207 | A * | 9/1991 | Chamberlain | 5/496 |
| 5,628,077 | A * | 5/1997 | Briganti | 5/496 |
| 6,108,837 | A * | 8/2000 | Knebel, III | 5/504.1 |
| 2008/0028522 | A1 * | 2/2008 | Atwood | 5/496 |
| 2008/0155749 | A1 * | 7/2008 | Stevens | 5/496 |

* cited by examiner

*Primary Examiner* — Michael Trettel
(74) *Attorney, Agent, or Firm* — Lyman Moulton, Esq.

(57) ABSTRACT

A drawstring secured fitted sheet where the corners are fashioned to avoid binding the string. It has a hem that holds the drawstring that is fabricated separately to allow that the edges of the sheet can be curved. The hem is terminated short of closing to allow a gap for the drawstring to exit. A stiffener is added at the gap to hold it open. There can be a block or pulley added to aid in tightening.

10 Claims, 5 Drawing Sheets

DRAWSTRING FITTED SHEET

Provisional application reference: 61/571,307 Filed: Jun. 24, 2001 Improvement to invention U.S. Pat. No. 5,628,077

BACKGROUND

This invention pertains to fitted sheets for beds and in particular to drawstring sheets where a drawstring is used instead of elastic to tighten and secure the sheet over and around the mattress. In the previous design disclosed in U.S. Pat. No. 5,628,007 the fabrication was problematic as the hem is curved and it is difficult to form a curved hem.

Another problem is that The corners were avoided and left open between the tabs that lie beneath the mattress and the string exited one tab and then entered the adjacent tab at the four corners. The disadvantages were that the open corner has extra edges to finish. Also the extra exposed string at the corners caused extra effort to apply the sheet to the mattress. (See U.S. Pat. No. 5,628,077)

PRIOR ART

There is no known prior art pertaining to this invention as the previously sighted patent is the last known issued patent and this application covers improvements to its unique design.

SUMMARY

The improvement of this invention entails adding a separately fabricated hem to the edge of the sheet enabling it to form a curve much more easily. The added hem is terminated just short of closing the full perimeter providing a gap for the string ends to exit the hem eliminating the need for exit holes to be fashioned. At the gap and extending slightly there beyond, a stiffener is secured to hold the gap open.

The new design also incorporates a gather panel that bridges the wedge shaped space between the four tabs at the corners. The gather panel is fashioned whereby there is no binding of the cord and no relative tightening of the fabric in the corner above the tension in the fabric extending directly from the sides and the top and bottom. The arrangement allows that the cord passes from one tension panel to the adjacent panel without being diverted by the corner gather panels.

DESCRIPTION

Figure 1:
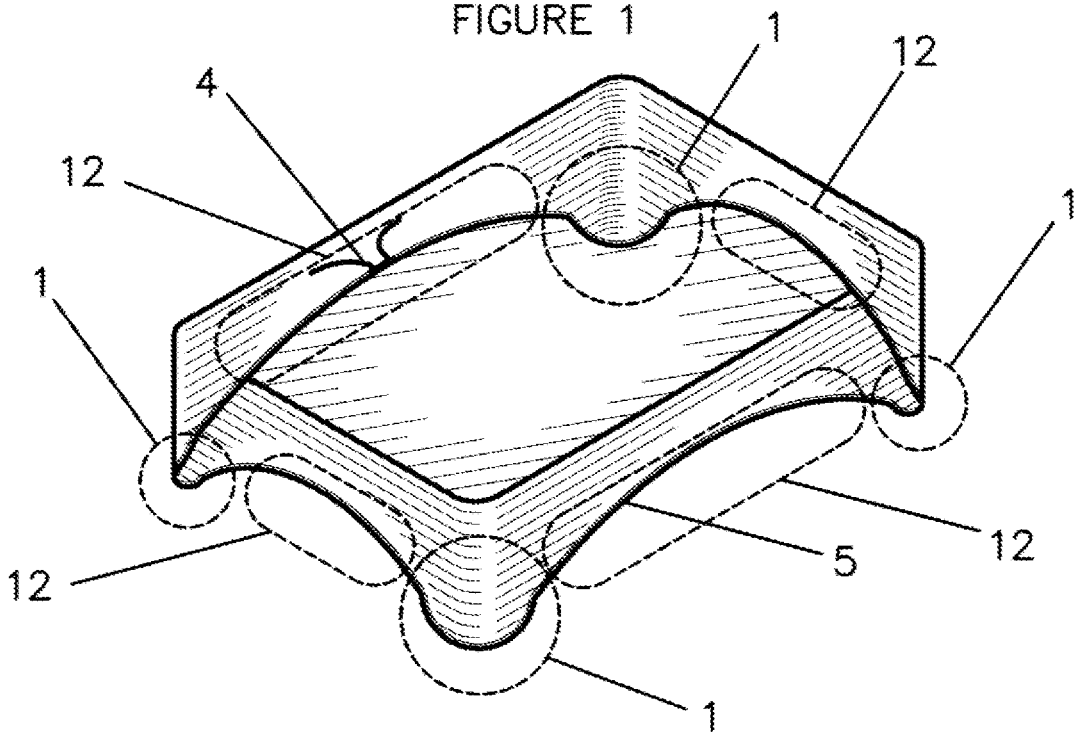
FIG. 1 shows the sheet without the mattress in the untightened form showing gather panel area 1, Sheet edge areas 12, drawstring 4 and hem 5.
Figure 2:
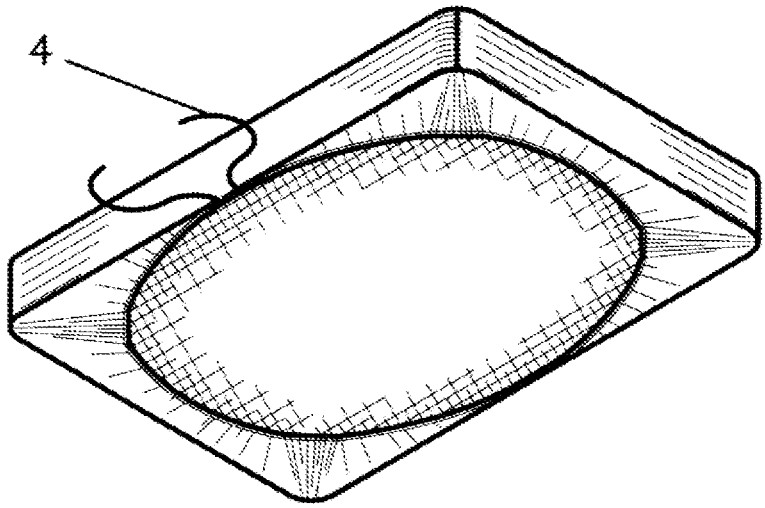
FIG. 2 shows the sheet applied to the mattress and tightened.
Figure 3:
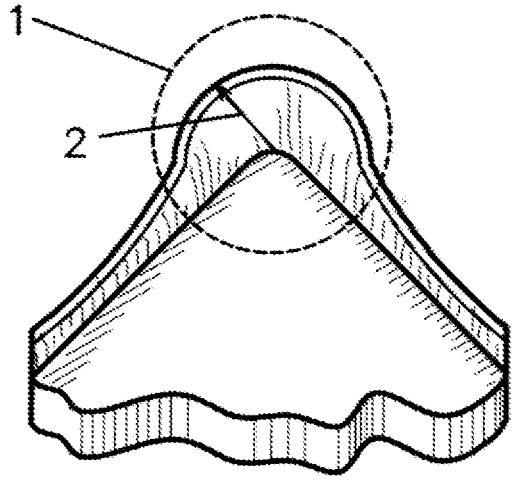
FIG. 3 shows sheet applied to bed and further shows the radius 2 to the edge of the gather panel area 1 in detail. (shown upside down)
Figure 4:
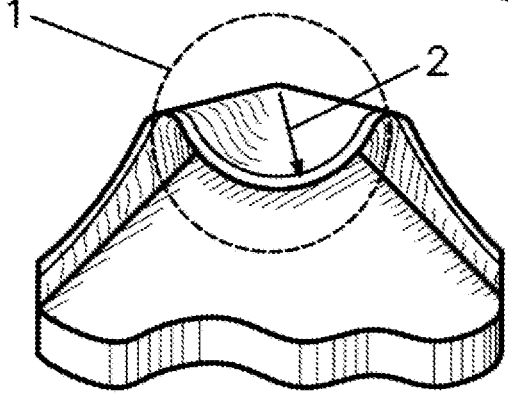
FIG. 4 further illustrates the radius 2 from the mattress corner to the edge of the gather panel area 1 in detail with the gather panel area folded to the mattress lower surface. (shown upside down)
Figure 5:
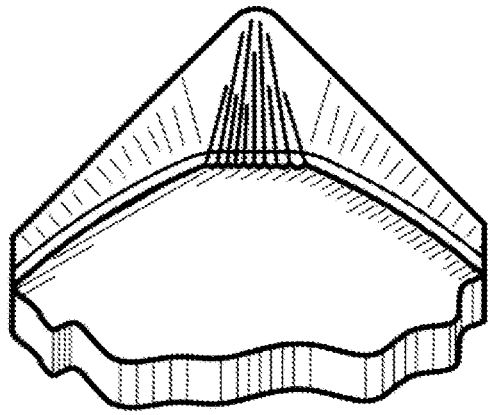
FIG. 5 shows corner in detail with the drawstring 4 tight. (shown upside down)
Figure 6:
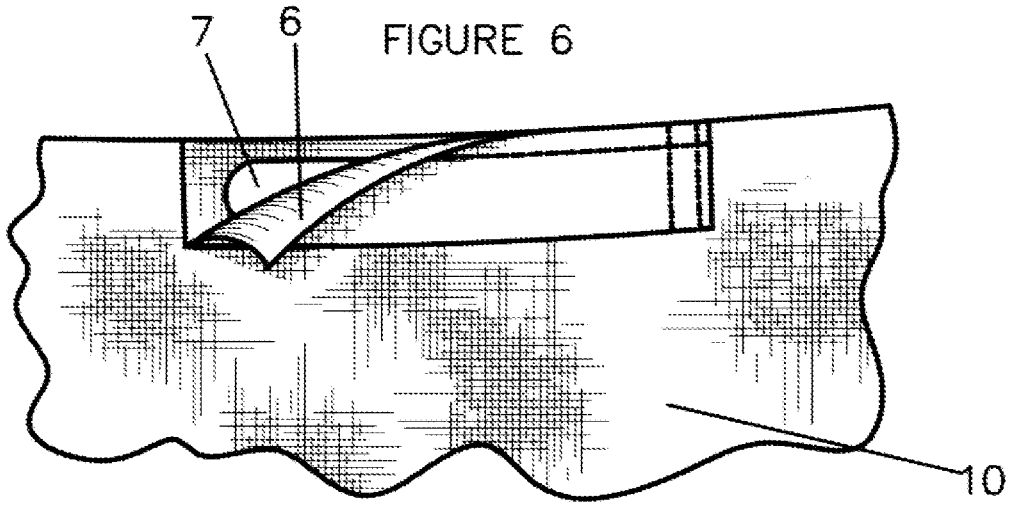
FIG. 6 Shows the constriction of stiffener jacket housing 6 and stiffener 7.
Figure 7:
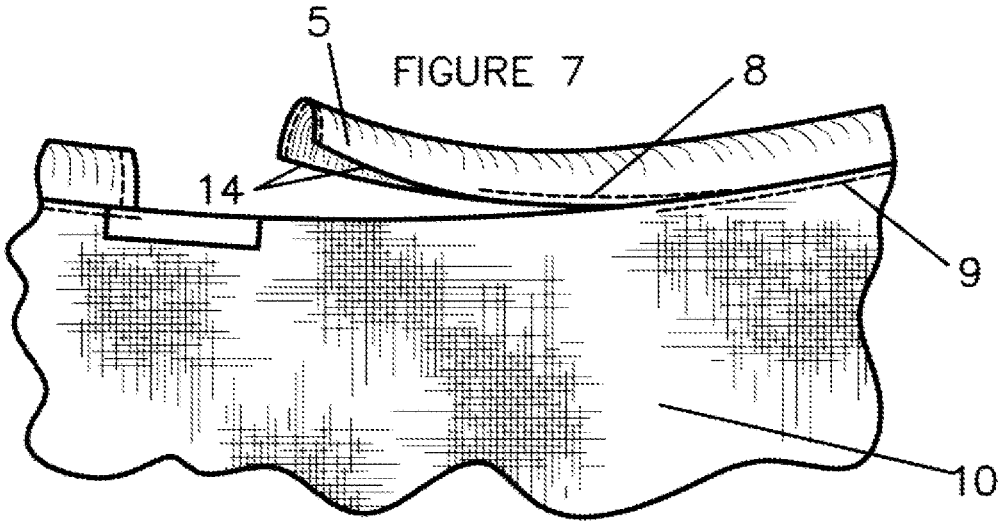
FIG. 7 shows the construction of the hem 5 closed with stitching 8 and sewn to sheet body 10 with stitching 9.
Figure 8:
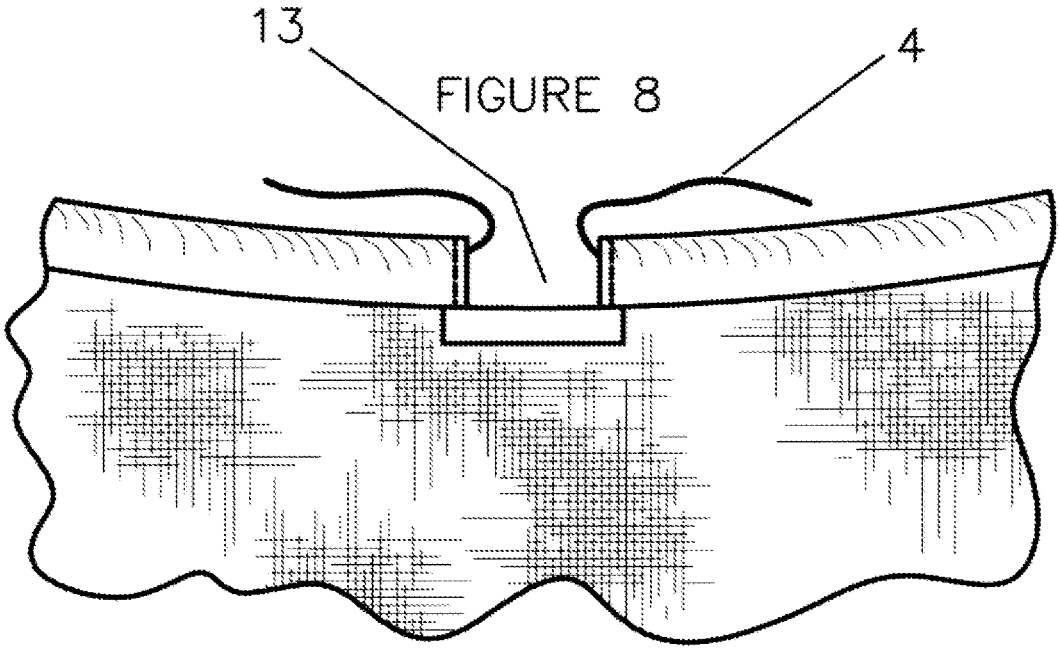
FIG. 8 shows the sheet construction completed and the gap 13 at the terminations of hem 5 with drawstring 4 in place.
Figure 9:
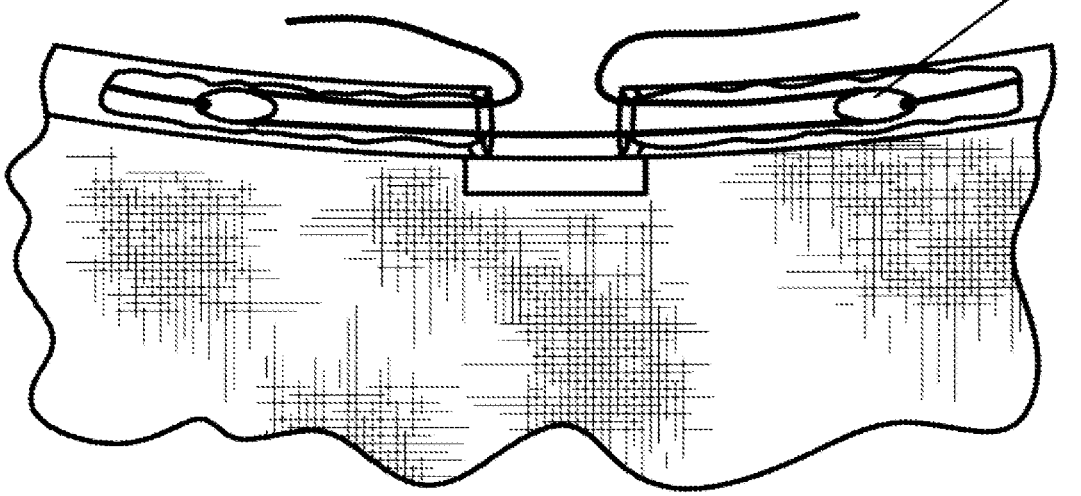
FIG. 9 shows broken away view of alternate design with block 11 inside the hem 5. This design allows extra tension from the multiplying effect of the block 11.

This invention enables the drawstring sheet with curved hems to be one continuous membrane with one continuous hem all around the sheet without the need to add extra hems and terminations to elements due to separate panels. It is made in the same fashion as anyone skilled in the art has made fitted sheets. In the corner areas there is a fan shaped gather panel 1 where the edge forms an approximate radius 2 where the approximate position of the mattress lower corner would lie. As shown in the drawings this radius 2 will enable the gather panel 1 to remain relatively loose allowing the tension from the drawstring 4 to developed mainly in the adjacent side panels 12. This also provides that the gathering of the hem 5 along the edge of the gather panel will not bind the string allowing it to pass through the gathered hem 5 in the corner with low friction.

Figure 10:
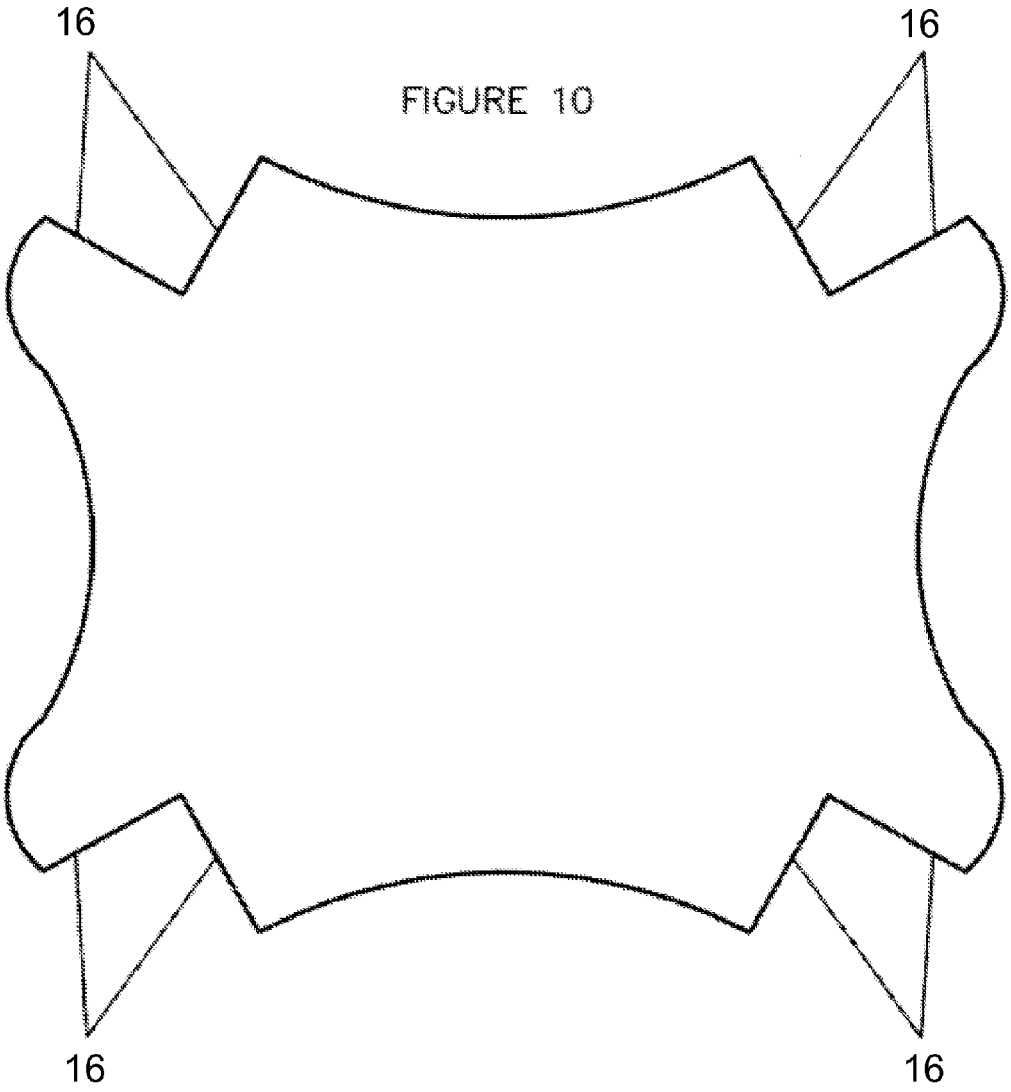
FIG. 10 shows the pattern for cutting the fabric for the sheet body 10.

Construction:

The body of the sheet is cut with the pattern shown in FIG. 10. The sheet body is formed into the pocket shape by sewing the corner edges 16 closed. The hem 5 is formed by folding a strip of fabric and sewing it closed along the open edges 14. The hem 5 is finished on one end and then sewn onto the edge of the sheet starting near the midpoint of one side. Hem 5 is sewn all the way around the sheet body until it comes near completing the full perimeter. The hem is then finished to the appropriate length allowing for the gap 13 to provide for the exit of the string ends and provide space for a cord locking device. The string is threaded through hem 5 using a stringing rod or stringing worm as done with any drawstring garment or other drawstring item. This is only one of the preferred embodiments of this fitted sheet. In another embodiment, the fitted sheet may be configured to fit a similar substantially prismatic shaped object. Many possibilities exist that may fulfill the object of the invention the scope of which is covered in the following claims.

I claim:

1. A fitted sheet comprising a main body of fabric formed to fit a mattress; said mattress having a bottom surface forming a plurality of lower edges; said lower edges meeting to form a set of lower corners; said fitted sheet having a portion of its edge extending at least partly beneath said mattress; said sheet edge having a plurality of regions corresponding to said mattress lower edges and another plurality of regions corresponding to said mattress corners; said sheet edge having a hem attached surrounding a sheet substantial periphery; said hem made from a separate fabric strip folded at its center long axis and sewn to form a cylinder; said hem containing one or more drawstrings throughout the length of said hem; a sheet edge region corresponding with each said lower corners forming a gather panel to prevent tension on said edge regions adjacent to said mattress lower corners preventing a binding of said one or more drawstrings; said hem having one or more termination points to allow said one or more drawstrings to exit said hem; said termination points having a distance from one another forming a gap.

2. Said fitted sheet in claim 1 where said drawstring is substituted with a continuous elastic cord.

3. Said fitted sheet in claim 1 where said gather panel forms a radius from said lower mattress corner position with said fitted sheet in place on said mattress.

4. Said fitted sheet in claim 1 where said gather panel forms a fan shape from said lower mattress corner position with said fitted sheet in place on said mattress.

5. Said fitted sheet in claim 1 where said gather panel is shaped to allow said drawstring to pass in a non-binding line from said sheet edge regions corresponding to said mattress lower edges to adjacent said sheet edge regions corresponding to said mattress lower edges.

6. Said fitted sheet in claim 1 with said drawstring configured to enter a first opening in said hem at said gap and traversing the complete hem one or more times around said mattress and exiting said hem at a second opening in said hem at said gap.

7. Said fitted sheet in claim 1 wherein said hem has a first opening at one end and a second opening at an opposite end; a first drawstring within said hem substantially shorter than said hem and having a first end and a second end; said first drawstring having said first end positioned near said hem first opening at one end and said second end positioned near said hem second opening at the opposite end; said first drawstring having a first rigging block lying within said hem attached to said first end of said first drawstring associated with said first hem opening and a second rigging block attached to said second end of said first drawstring associated with said hem second opening; each said rigging blocks having a passage; a second drawstring entering said hem first opening toward said first rigging block and passing through said passage associated with said first rigging block; said second drawstring doubling back on its self and exiting said hem first opening and then entering said hem second opening toward said second rigging block; said second drawstring passing through said passage associated with said second rigging block; said second drawstring doubling back on its self and exiting said hem second opening.

8. Said fitted sheet in claim 7 wherein said rigging block is fashioned with an oblong shape whereby it can move within said hem with low friction.

9. Said fitted sheet in claim 7 wherein said rigging block is a pulley.

10. Said fitted sheet in claim 9 wherein said pulley is fashioned with an oblong shape whereby it can move through said hem with low friction.

* * * * *